US012331632B2

(12) United States Patent
Thomas et al.

(10) Patent No.: US 12,331,632 B2
(45) Date of Patent: Jun. 17, 2025

(54) ANALYZING HYDROCARBON FLOW INTO MULTI-LATERAL WELLS BY RELEASING TRACERS FROM THE SURFACE

(71) Applicant: Saudi Arabian Oil Company, Dhahran (SA)

(72) Inventors: Gawain Thomas, Cambridge, MA (US); Hsieh Chen, Cambridge, MA (US); Martin E. Poitzsch, Cambridge, MA (US)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/317,335

(22) Filed: May 15, 2023

(65) Prior Publication Data

US 2024/0384648 A1 Nov. 21, 2024

(51) Int. Cl.
*E21B 47/11* (2012.01)

(52) U.S. Cl.
CPC ..... *E21B 47/11* (2020.05)

(58) Field of Classification Search
CPC ..... E21B 47/11
See application file for complete search history.

(56) References Cited

U.S. PATENT DOCUMENTS 3,623,842 A 11/1971 Deans
4,558,219 A * 12/1985 LeBlanc ..... E21B 47/11 250/260
8,949,029 B2 2/2015 Nyhavn
(Continued)

FOREIGN PATENT DOCUMENTS

GB 2528716 2/2016
GB 2569868 7/2019
(Continued)

OTHER PUBLICATIONS

Aggrey et al., "A Novel Approach of Detecting Water Influx Time in Multi-Zone and Multilateral Completions Using Real-Time Downhole Pressure Data," Presented at the SPE Middle East Oil and Gas Show and Conference, Manama, Bahrain, Mar. 11-14, 2007, 11 pages.
(Continued)

*Primary Examiner* — Giovanna Wright
*Assistant Examiner* — Ronald R Runyan
(74) *Attorney, Agent, or Firm* — Fish & Richardson P.C.

(57) ABSTRACT

Hydrocarbon flow into multi-lateral wells is analyzed by controlled release of tracers from the surface. Hydrocarbons flow into a lateral formed from a wellbore into a subterranean zone. A wellbore production tubing is installed within the wellbore and extends toward the lateral. The wellbore production tubing defines an annulus between an outer surface of the tubing and an inner wall of the wellbore. Hydrocarbons flowing from the lateral into the annulus flow within an internal volume defined by a body attached to the outer surface of the tubing. The hydrocarbons mix with tracers residing within the internal volume. A mixture of the hydrocarbons with the tracers flow out of the internal volume and towards the surface. At the surface, a concentration of the tracers in the mixture flowed to the surface is analyzed. Based on a result of the analyzing, properties of hydrocarbon flow into the lateral are determined.

18 Claims, 6 Drawing Sheets

(56) References Cited

U.S. PATENT DOCUMENTS

| | | | | |
|---|---|---|---|---|
| 9,133,683 | B2 | 9/2015 | Dyer et al. | |
| 9,284,833 | B2 | 3/2016 | Hewitt et al. | |
| 9,910,026 | B2 | 3/2018 | Zhang et al. | |
| 10,815,775 | B2 | 10/2020 | Lauritzen | |
| 10,871,067 | B2 | 12/2020 | Nyhavn | |
| 11,773,715 | B2 | 10/2023 | Poitzsch et al. | |
| 2011/0239754 | A1* | 10/2011 | Dyer | E21B 47/11 73/152.18 |
| 2011/0257887 | A1* | 10/2011 | Cooper | E21B 47/11 702/12 |
| 2014/0299756 | A1* | 10/2014 | Cameron | E21B 47/11 250/259 |
| 2015/0192008 | A1* | 7/2015 | Dikshit | E21B 47/11 166/250.12 |
| 2016/0010454 | A1* | 1/2016 | Sira | G01F 1/704 73/152.29 |
| 2018/0275114 | A1 | 9/2018 | Kosynkin et al. | |
| 2018/0282605 | A1 | 10/2018 | Borrell | |
| 2018/0298274 | A1 | 10/2018 | Zhao | |
| 2019/0382652 | A1 | 12/2019 | Brierley | |
| 2020/0032641 | A1 | 1/2020 | Kulyakhtin et al. | |
| 2021/0332695 | A1 | 10/2021 | Shaw | |
| 2022/0065101 | A1 | 3/2022 | Poitzsch et al. | |

FOREIGN PATENT DOCUMENTS

| | | |
|---|---|---|
| NO | 20140495 | 6/2014 |
| WO | WO 2012057634 | 5/2012 |
| WO | WO 2014104914 | 7/2014 |
| WO | WO 2016105210 | 6/2016 |
| WO | WO 2019066811 | 4/2019 |
| WO | WO 2020239649 | 12/2020 |

OTHER PUBLICATIONS

Andresen et al., "Interventionless Surveillance in a Multi-Lateral Horizontal Well," Presented at the IADC/SPE Drilling Conference and Exhibition, San Diego, California, Mar. 6-8, 2012, 9 pages.

Anopov et al., "Permanent Downhole Chemical Tracer System for Wireless Surveillance and Optimizing Well Production," Presented at the SPE/IADC Middle East Drilling Technology Conference and Exhibition, Abu Dhabi, UAE, Jan. 31, 2018, 13 pages.

Chen et al., "Optimization of Tracer Injection Schemes for Improved History Matching," SPE-206142-MS, OnePetro, Sep. 2021, 9 pages.

Chen et al., "Upconversion Nanoparticles: Design, Nanochemistry, and Applications in Theranostics," Chemical Reviews, Mar. 2014, 114(10):5161-5214, 101 pages.

Dyer et al., "Technology Update: New Intelligent Completion System Enables Compartment-Level Control in Multilateral Wells," Journal of Petroleum Technology, Sep. 2016, 68(09):18-21, 3 pages.

Dyrli et al., "Ten Years of Reservoir Monitoring with Chemical Inflow Tracers—What Have We Learnt and Applied Over the Past Decade?" presented at the SPE Kuwait Oil & Gas Show and Conference, Kuwait City, Kuwait, Oct. 17, 2017, 22 pages.

Hu, "Utilizing Oil-soluble Tracers to Evaluate the Production Profile in Multistage Fractured Horizontal Wells," Thesis for the Degree of Master of Applied Science in Petroleum Systems Engineering, University of Regina, Dec. 2019, 186 pages.

Isoppo et al., "Highly Fluorescent Lipophilic 2,1,3-Benzothiadiazole Fluorophores as Optical Sensors for Tagging Material and Gasoline Adulteration with Ethanol," Sensors and Actuators B: Chemical, Apr. 2020, 35 pages.

Jose et al., "Benzophenoxazine-Based Fluorescent Dyes for Labeling Biomolecules," Tetrahedron, Nov. 2006, 62:(48):11021-11037, 17 pages.

Joubran, "Intelligent Completions: Design and Reliability of Interval Control Valves in the Past, Present, and Future," presented at the Offshore Technology Conference, Houston, Texas, May 3, 2018, 29 pages.

Li et al., "Evaluation of the Release Mechanism of Sustained-Release Tracers and its Application in Horizontal Well Inflow Profile Monitoring," ACS Omega, Jul. 19, 2021, 6(29):19269-19280, 12 pages.

Muradov et al., "Zonal Rate Allocation in Intelligent Wells," presented at the EUROPEC/EAGE Conference and Exhibition, Amsterdam, the Netherlands, Jun. 8-11, 2009, 13 pages.

Oftedal et al., "Permanent Chemical Tracers Piloted for Inflow Monitoring in Cemented Production Liner," Prepared for presentation at the Offshore Technology Conference held in Houston, Texas, May 2-5, 2016.

Ow et al., "First Deployment of a Novel Advanced Tracers System for Improved Waterflood Recovery Optimization," presented at the Abu Dhabi International Petroleum Exhibition & Conference, Abu Dhabi, UAE, Nov. 12-15, 2018, 10 pages.

pubchem.ncbi.nlm.nih.gov [online], "2-(2-Ethylhexyl)-6,7-dimethoxy-1H-benz[de]isoquinoline-1,3(2H)-dione," available on or before Mar. 6, 2024, via Internet Archive: Wayback Machine URL <https://web.archive.org/web/20240306211042/https://pubchem.ncbi.nlm.nih.gov/compound/92025#section=2D-Structure>, retrieved on Mar. 6, 2024, 12 pages.

pubchem.ncbi.nlm.nih.gov [online], "Bis(2-methylpropyl) 4, 10-dicyanoperylene-3,9-dicarboxylate," available on or before Mar. 6, 2024, via Internet Archive: Wayback Machine URL <https://web.archive.org/web/20240306210457/https://pubchem.ncbi.nlm.nih.gov/compound/13750327>, retrieved on Mar. 6, 2024, 15 pages.

pubchem.ncbi.nlm.nih.gov [online], "Perylene Red," available on or before Mar. 6, 2024, via Internet Archive: Wayback Machine URL <https://web.archive.org/web/20240306211744/https://pubchem.ncbi.nlm.nih.gov/compound/16172388#section=Deprecated-CAS>, retrieved on Mar. 6, 2024, 16 pages.

Salimov et al., "Allocation of Zonal Production in Smart Wells: Offshore Abu-Dhabi Case Study," presented at the Abu Dhabi International Petroleum Exhibition & Conference, Abu Dhabi, UAE, Nov. 16, 2017, 11 pages.

Thomas et al., "Deployment and Detection of a Novel Barcoded Advanced Tracers System for the Optimization of Improved Waterflood Recovery in Hydrocarbon Reservoirs," presented at the SPE Middle East Oil and Gas Show and Conference, Manama, Bahrain, Mar. 20, 2019, 10 pages.

Williams et al., "Wireless Reservoir Surveillance Using Intelligent Tracers," presented at the Offshore Technology Conference, Houston, Texas, Apr. 30-May 3, 2012, 11 pages.

Zhou et al., "Upconversion Luminescent Materials: Advances and Applications," Chemical Reviews, Dec. 2014, 115(1):395-465, 71 pages.

* cited by examiner

ANALYZING HYDROCARBON FLOW INTO MULTI-LATERAL WELLS BY RELEASING TRACERS FROM THE SURFACE

TECHNICAL FIELD

This disclosure relates to releasing tracers within wellbores, e.g., to analyze properties of hydrocarbon flow through the wellbores.

BACKGROUND

During hydrocarbon production, a single wellbore can produce from multiple production zones by passing through multiple, stacked production zones, branching out into sidetrack wellbores, or through other arrangements. In some implementations, production fluid from various production zones are directed through the wellbore by separate production tubing. In some implementations, the production fluid from various production zones are comingled and directed through a single production tubing string. Once at a topside facility, the production fluid is separated into its various components: oil, water, and gas.

SUMMARY

This specification describes technologies relating to controlled release of tracers into multi-lateral wells.

Certain aspects of the subject matter described here can be implemented as a method in a wellbore formed in a subterranean zone from a surface of the Earth. A lateral is formed from the wellbore into the subterranean zone. Hydrocarbons entrapped in the subterranean zone flow into the lateral. A wellbore production tubing is installed within the wellbore and extend toward the lateral. The wellbore production tubing defines an annulus between an outer surface of the wellbore production tubing and an inner wall of the wellbore. A portion of the hydrocarbons flowing from the lateral into the annulus flow within an internal volume defined by a body attached to the outer surface of the wellbore production tubing. The portion of the hydrocarbons mix with tracers residing within the internal volume. A mixture of the portion of the hydrocarbons with a portion of the tracers flow out of the internal volume and towards the surface. At the surface, a concentration of the tracers in the mixture flowed to the surface is analyzed. Based on a result of the analyzing, properties of hydrocarbon flow into the lateral are determined.

An aspect combinable with any other aspect includes the following features. To flow the portion of the hydrocarbons within the internal volume defined by the body, the body is attached to the outer surface of the wellbore production tubing at a downhole location that is downstream of an inlet to the lateral.

An aspect combinable with any other aspect includes the following features. The body includes an inlet to the internal volume that is downstream of the inlet to the lateral and an outlet from the internal volume that is downstream of the inlet of the body. To flow the portion of the hydrocarbons within the internal volume, the portion of the hydrocarbons are flowed into the inlet of the body.

An aspect combinable with any other aspect includes the following features. The tracers are flowed into the internal volume before flowing the portion of the hydrocarbons into the inlet of the body.

An aspect combinable with any other aspect includes the following features. The tracers are flowed from a reservoir at the surface through a flowline that extends from the surface to within the internal volume of the body.

An aspect combinable with any other aspect includes the following features. To analyze the concentration of the tracers in the mixture flowed to the surface, after flowing the mixture into the wellbore production tubing, flow of the tracers into the internal volume is shut off. Then, a time rate of decay of the concentration of the tracers reaching the surface of the wellbore is measured.

An aspect combinable with any other aspect includes the following features. A check valve is fluidically disposed in the flowline. The check valve is configured to permit flow of the tracers within the internal volume through the flowline and to prevent flow out of the internal volume through the flowline.

An aspect combinable with any other aspect includes the following features. To flow the mixture into the wellbore production tubing and towards the surface, an inflow control valve to flow the mixture from the annulus into the wellbore production tubing is operated.

An aspect combinable with any other aspect includes the following features. To flow, out of the internal volume and towards the surface, the mixture of the portion of the hydrocarbons with a portion of the tracers, a duration for which the portion of the hydrocarbons resides within the internal volume is increased before flowing the mixture out of the internal volume.

An aspect combinable with any other aspect includes the following features. To increase the duration, the internal volume is filled with porous beads between the inlet and the outlet.

An aspect combinable with any other aspect includes the following features. To increase the duration, multiple baffles are positioned within the internal volume between the inlet and the outlet.

Certain aspects of the subject matter described here can be implemented as an apparatus. The apparatus includes a body defining an internal volume. The body can be attached to an outer surface of a wellbore production tubing in an annulus defined by the outer surface of the wellbore production tubing and an inner wall of a wellbore formed in a subterranean zone from a surface of the Earth. A lateral is formed in the subterranean zone. Hydrocarbons entrapped in the subterranean zone flow into the lateral, into the annulus and towards the surface. The body includes an inlet to and outlet from the internal volume; each defined on a surface of the body. When the body is attached to the outer surface of the wellbore production tubing with the inlet nearer to the lateral than the outlet, the inlet allows at least a portion of the hydrocarbons to enter the internal volume and the outlet allows at least the portion of the hydrocarbons to exit the internal volume. A dosing line extends from the surface to within the internal volume. The dosing line is configured to flow fluid from the surface to the body. A tracer is configured to be flowed into the internal volume from the surface through the dosing line. At least a portion of the tracer is configured to mingle with at least the portion of the hydrocarbons that enter the internal volume through the inlet and to flow out of the body and to the surface with at least the portion of the hydrocarbons that exit through the outlet. A concentration of at least the portion of the tracer at the surface is indicative of a percentage of a total hydrocarbon flow coming into the lateral from the subterranean zone.

An aspect combinable with any other aspect includes the following features. The body includes multiple beads positioned within the internal volume. The multiple beads form a porous bed of beads between the inlet and the outlet. The tracer is distributed across the porous bed of beads.

An aspect combinable with any other aspect includes the following features. The body includes multiple baffles formed within the internal volume. A first end of each baffle is attached to an inner surface of the body. A second end of each baffle extends away from the inner surface into the internal volume. The multiple baffles define a tortuous flow path between the inlet and the outlet.

An aspect combinable with any other aspect includes the following features. The body defines a ring shape with a hollow center. The ring-shaped body is configured to be wrapped around the wellbore production tubing.

An aspect combinable with any other aspect includes the following features. A strap is configured to attach the body to the outer surface of the wellbore production tubing.

An aspect combinable with any other aspect includes the following features. The apparatus includes a check valve fluidically coupled to the dosing line. The check valve is configured to permit fluid flow from the surface into the body and to prevent fluid flow out of the body.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1A:
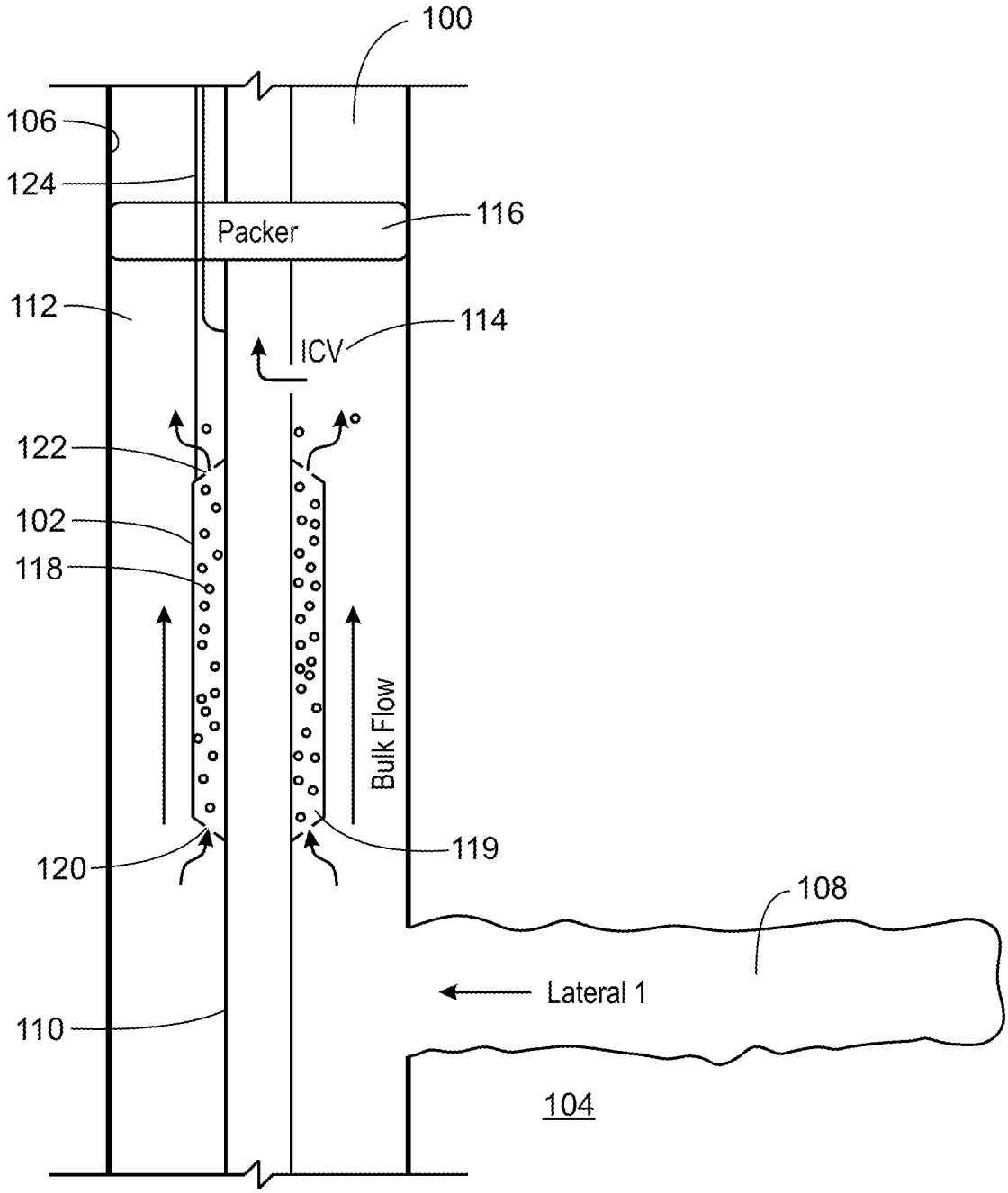
FIG. 1A is an example of a schematic view of a wellbore in which a tracer injection apparatus is installed.

To determine oil production rates and water cuts within multi-zone, comingled wells, tracers are injected into multiple zones. Each zone of tracers is barcoded to identify the zone. The tracers include hydrophilic and oleophilic tracers. A transient is performed on the tracer injection. The transient creates a decay profile that can be detected at the topside facility. The profiles for each individual production zone can be used to determine a water cut for each zone. The various production zones can then be throttled to optimize hydrocarbon production.

In some applications, tracers are used to analyze zonal flow contributions from multiple zones through which a well that has two (or more) lateral sections is formed. The zones are isolated from each other with packers. The flow from each lateral enters the motherbore (i.e., the common wellbore production tubing) through respective inflow control valves (ICVs). An ICV has a variable orifice dimension settable from the surface, e.g., via a hydraulic control line or via electrical control. Using the ICV, an operator can increase or throttle back flow from each lateral well independently. Such zonal flow control can be performed, e.g., to delay the onset and increase of total water production from the well.

In such applications, tracers are injected into separate annular spaces in the wellbore via respective dosing lines, i.e., tubulars or pipelines that run from a tracer reservoir at the surface to respective downhole locations in which tracers are to be deposited. Tracers injected into a zone are carried to the surface by well fluids (i.e., hydrocarbons) that flow into the zone through the lateral formed in the zone. The tracers can be oleophilic tags that can be used to identify oil production or hydrophilic tags that can be used to identify water production or a combination of the two. By measuring a concentration and other flow properties (e.g., volumetric flow rate) of the tracers at the surface, the oil production contributions of different laterals as well as water contributions can be determined. In particular, the oil production contributions can be analyzed only using surface measurements instead of downhole measurements using equipment such as cabling and electronics.

The transient method of quantifying flow rate contributions from multiple laterals using tracers employs an abrupt shut-off of the tracer injection and posits that the decay rate of tracer concentration following the shut-off is proportional to the flow contributed by the lateral in which the tracers were injected. In real-world production conditions, however, the flow rate can be high enough to result in decay times as short as a few seconds. Such rapid decay times create technical challenges for accurately capturing the decay rate. This disclosure describes techniques to slow the rate at which tracers are flushed out of the annular space while preserving the flow-rate dependent nature of the delay.

This disclosure describes a diffuser-like apparatus that can slow down the release of injected tracers while retaining a flow-dependent decay characteristic. Doing so enables measurements of zonal flow contributions over a wide range of flow rates. The apparatus disclosed here can be charged (i.e., filled or injected) with tracer from the surface using a dosing line at any time according to the needs of the operator, and can therefore be re-used indefinitely. The apparatus described here is passive and does not require batteries or any other power source. Consequently, the lifetime of the device is not limited by the apparatus' capacity to store tracers or the life of any batteries to operate the apparatus. Some implementations of the device contain no moving parts.

FIG. 1A is an example of a schematic view of a wellbore 100 in which a tracer injection apparatus 102 is installed. The wellbore 100 extends from a surface to a subsurface reservoir through a subterranean zone 104 (e.g., a formation, a portion of a formation, multiple formations). A casing 106 is installed in the wellbore 100. A lateral 108 extends from a window formed in the casing 106. Hydrocarbons from the subterranean zone 104 flow into the lateral 108, and from the lateral 108 into the wellbore 100 towards the surface. A wellbore production tubing 110 is installed in the wellbore 100. The tubing 110 defines an annulus 112 between an outer surface of the tubing 110 and the casing 106. With the tubing 110 installed within the wellbore 100, hydrocarbons from the lateral 108 flow into the annulus 112. An inflow control valve (ICV) 114 controls flow of the hydrocarbons from the annulus 112 into the tubing 110. Hydrocarbon flow through the annulus 112 upstream of the ICV 114 can be controlled by installing a packer 116 uphole of (i.e., downstream of) the ICV 114. By installing the packer 116 (and another packer downhole of window from which the lateral 108 is formed), hydrocarbon flow from the zone in which the lateral 108 is formed can be isolated from other zones in the subterranean zone. In addition, the ICV 114 working in cooperating with the packer 116 can cause the isolated hydrocarbons to flow into the tubing 110.

Tracers mixed with the isolated hydrocarbons flowing from the lateral 108 can be permitted to flow into the tubing 110 by the ICV 114. The tracers (schematically represented by circles 118 within the apparatus 102) can be stored in an internal volume defined by the apparatus 102. The apparatus 102 defines an inlet 120 through which a portion of the hydrocarbons from the lateral 108 enter the apparatus 102. Within the apparatus 102, the hydrocarbons mix with the tracers 118. The apparatus 102 defines an outlet 122 through which a mixture of the hydrocarbons and tracers exits the apparatus 102. In some implementations, the apparatus 102 is attached to the tubing 110 uphole of (i.e., downstream of) the lateral 108 such that the inlet 120 to the apparatus 102 is uphole of (i.e., downstream of) the lateral 108 and the outlet 122 to the apparatus is uphole of (i.e., downstream of) the inlet 120. The ICV 114, which permits the mixture of the tracers and hydrocarbons to enter the tubing 110, is uphole of (i.e., downstream of) the outlet 122.

In some implementations, the apparatus 102 includes a dosing line 124 (e.g., a tube or pipe) that extends from a surface of the wellbore 100 to within the internal volume 119 defined by the apparatus 102. At the surface, the dosing line 124 is connected to a reservoir and other flow equipment (not shown) using which tracers can be flowed through the dosing line 124 into the apparatus 102. Using the dosing line 124, an operator can fill (or refill) the apparatus 102 with tracers 118 so that a requisite volume of tracers 118 remains available at all times.

Figure 1B:
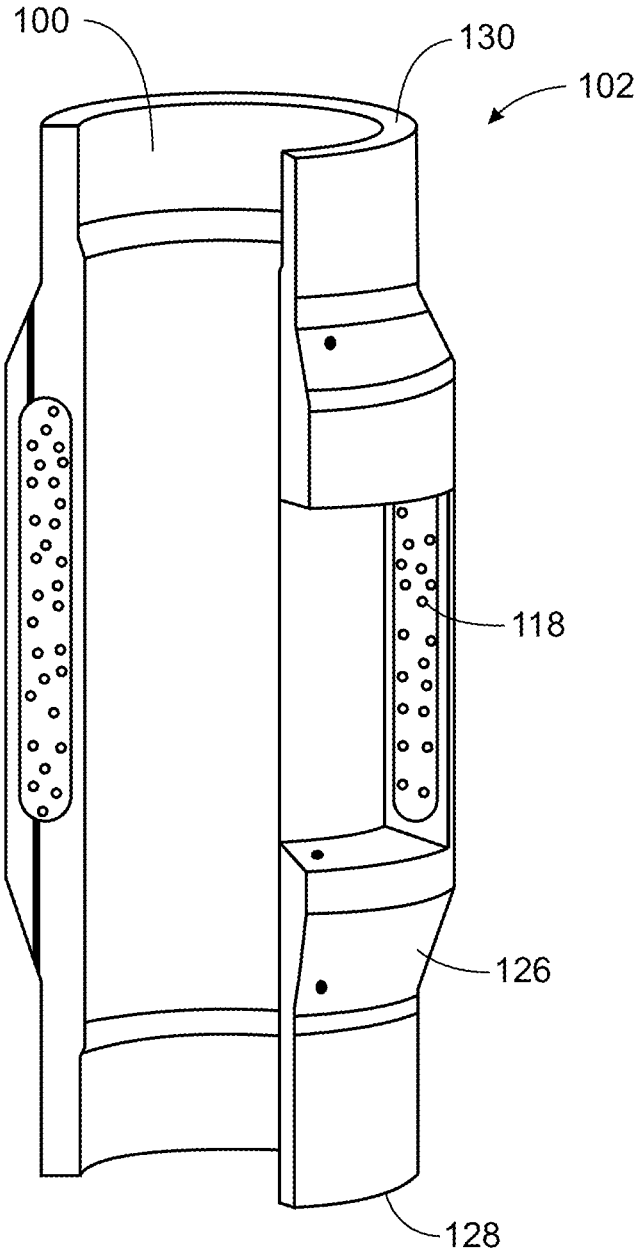
FIG. 1B is an example of a schematic view of the tracer injection apparatus installed in the wellbore of FIG. 1A.

FIG. 1B is an example of a schematic view of the tracer injection apparatus 102 installed in the wellbore 100. In some implementations, the apparatus 102 is shaped like an elongated ring that defines the internal volume 119 within which the tracers 118 are stored. An inner diameter of the ring-shaped apparatus is equal to or slightly greater than an outer diameter of the tubing 110 allowing the apparatus 102 to be wrapped around the tubing 110 at a desired downhole location, e.g., uphole of (i.e., downstream of) the lateral 108. In some implementations, the apparatus 102 can be wrapped around and further secured to the tubing 110 using clamps, straps or similar devices (not shown in FIG. 1B). The inlet 120 and the outlet 122 can be formed on the side surface 126 near a bottom and a top, respectively, of the apparatus 102, or on the lower surface 128 and upper surface 130, respectively.

In an example operation, the apparatus 102 can be installed around the wellbore production tubing 110 before the tubing 110 is installed within the wellbore 100. The dosing line 124 is passed through the packer 116 with one end of the dosing line 124 extending into the internal volume 119 defined by the body of the apparatus 102 and the other end of the dosing line 124 extending to a reservoir and flow equipment at the surface. The internal volume 119 can be filled with tracers 118 before or after lowering the apparatus 102 into the wellbore 100.

Hydrocarbons flowing from the subterranean zone 104 into the lateral 108 enter the wellbore 100 and flow towards the surface. A portion of the hydrocarbons flow into the inlet 120 of the apparatus 102 and enter the internal volume 119. In the internal volume 119, the hydrocarbons mix with the tracers 118 in the internal volume 119. A pressure of the flow carries facilitates mixing of the hydrocarbons and the tracers 118, and also causes the mixture to flow towards the outlet 122 of the apparatus 122 and into the annulus. The ICV 114 is opened to permit the mixture of the tracers and the hydrocarbons to enter the tubing 110. To perform transient testing, after a quantity of the mixture of the hydrocarbons and tracers 118 enters the tubing 110, the ICV 114 is left open and an injection of the tracers is stopped. Then, a decay rate of the tracers 118 at the surface is analyzed at the surface (not downhole). By determining a concentration of the tracers 118 after the tracer injection has been stopped, properties of the hydrocarbon flow from the subterranean zone can be determined. Examples of properties that can be determined include a percentage of the total flow coming from the zone.

Figure 2:
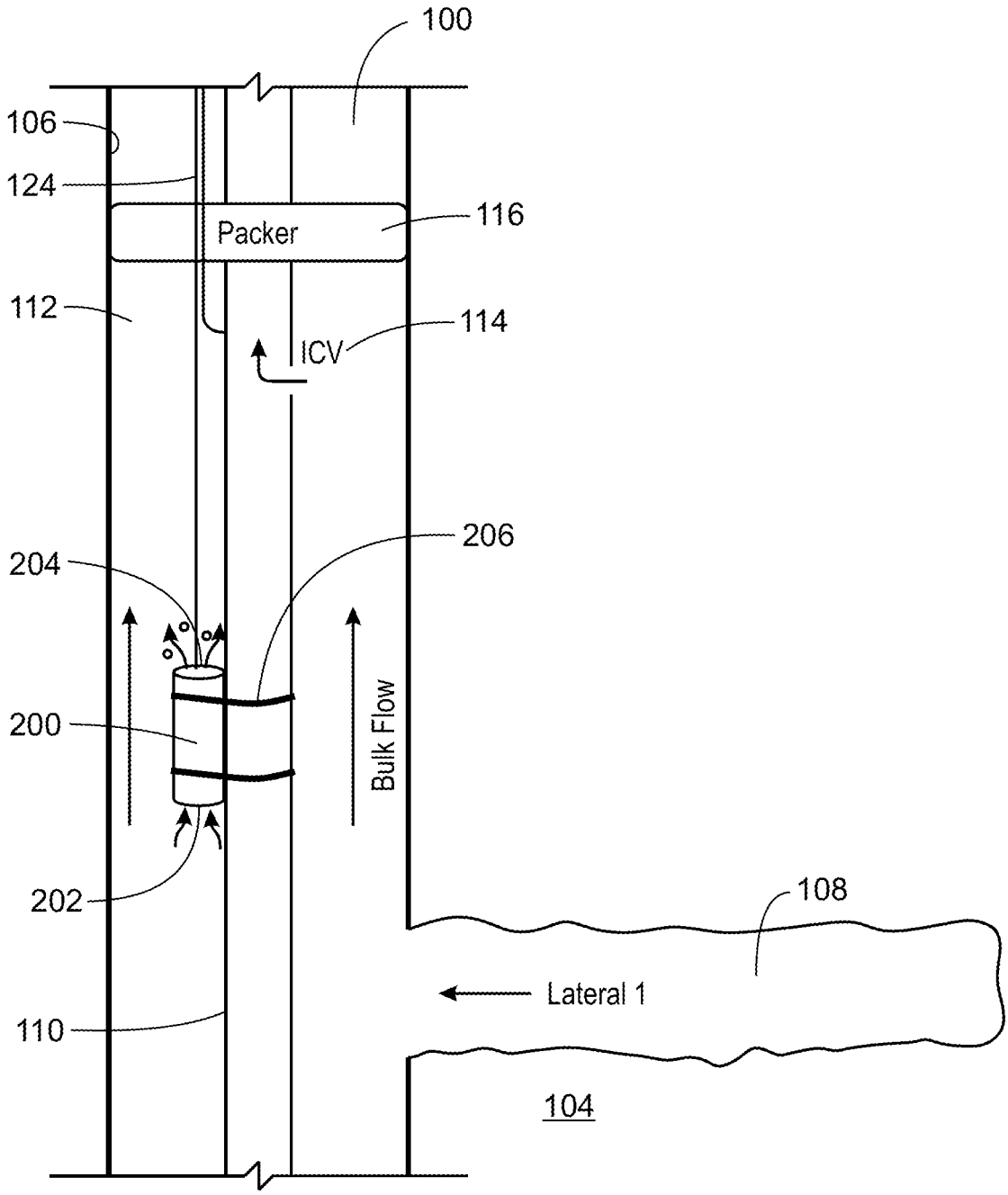
FIG. 2 is an example of a schematic view of a wellbore in which a tracer injection apparatus is installed.

FIG. 2 is an example of a schematic view of a wellbore in which a tracer injection apparatus 200 is installed. The apparatus 200 can be an alternative to the apparatus 102 described with reference to FIG. 1A. Alternatively, the apparatus 200 and the apparatus 102 can be used in the same well system, each to analyze contributions from two different zones. The apparatus 200 can be strapped to the side of the tubing 110, for example, using straps 206, clamps or other devices. The devices used to secure the apparatus 200 to the side of the tubing 110 can secure the apparatus 200 so as to withstand the forces generated by the hydrocarbons that flow from the lateral 108 towards the surface. The inlet 202 to the apparatus 200 is uphole of (i.e., downstream of) the inlet to the lateral 108, and the outlet 204 to the apparatus 202 is uphole of (i.e., downstream of) the inlet 202. The dosing line 124 extends from the surface into the internal volume defined by the apparatus 200. The operations performed to flow hydrocarbons from the lateral through the apparatus 200, to flow a mixture of the tracers and the hydrocarbons to the surface, and to analyze the tracers at the surface by shutting the tracer injection are substantially identical to corresponding operations described with reference to FIGS. 1A and 1B.

An operational efficiency of the apparatuses described in this disclosure depends, in part, on a quantity of tracers carried by the hydrocarbons to the surface. The quantity of tracers, in turn, depends on a time for which the hydrocarbons reside within the internal volume of the apparatus (residence time). One technique to control the residence time is to control a size of the openings (i.e., the inlet and the outlet) into the apparatus. Another technique to control a quantity of tracers that are mixed with the hydrocarbons is to control a bulk flow rate of the hydrocarbons through the annulus towards the surface. Further techniques to control the residence time are described with reference to FIGS. 3 and 4.

Figure 3:
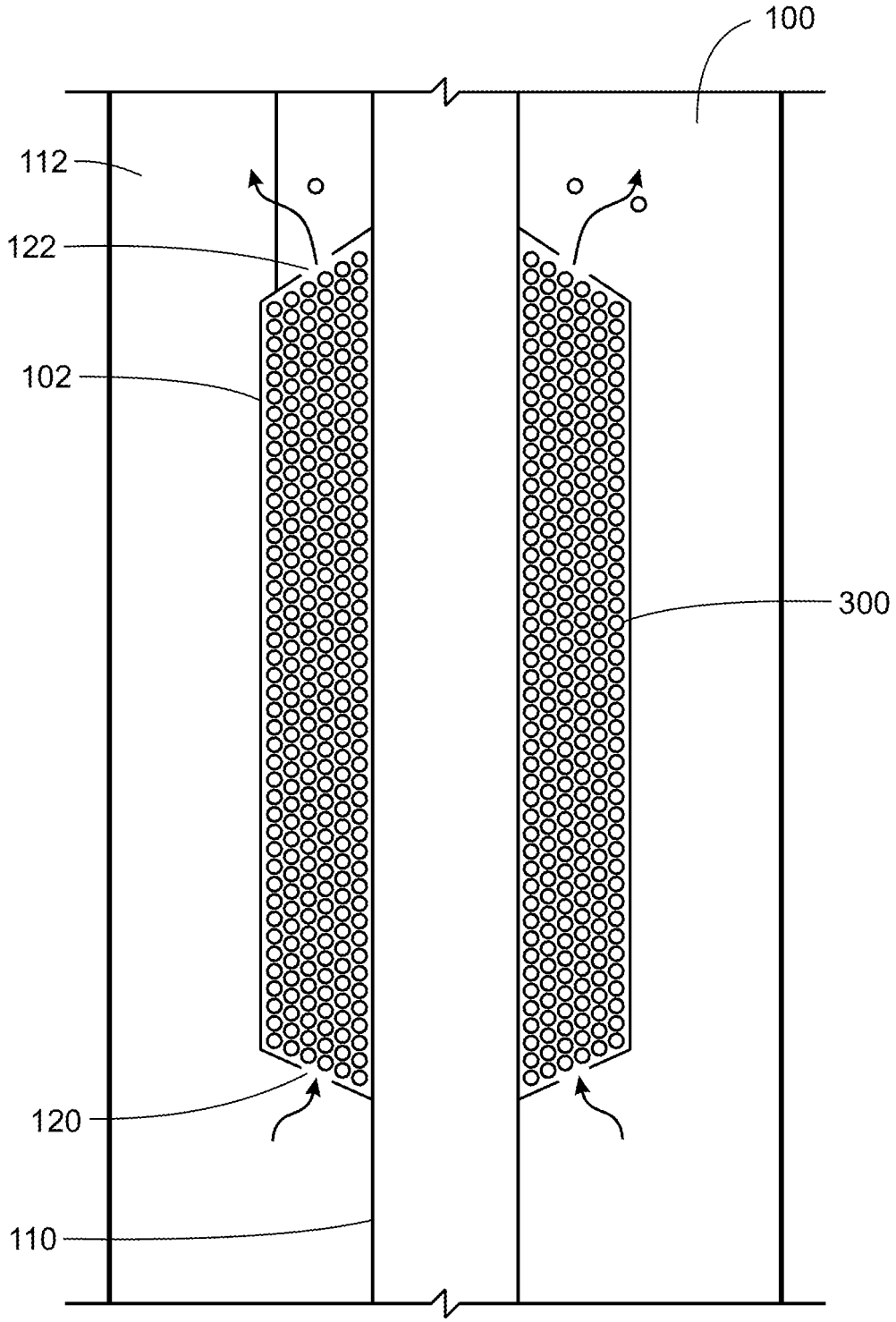
FIG. 3 is an example of a schematic view of a tracer injection apparatus filled with multiple beads.

FIG. 3 is an example of a schematic view of the tracer injection apparatus 102 filled with multiple beads 300. When the internal volume of the apparatus 102 is filled with the multiple beads, a porous bed of beads is formed. The tracers can be distributed throughout the porous bed, e.g., by mixing the tracers with the beads before filling the internal volume of the apparatus with the mixture. The porous bed offers resistance to flow of the hydrocarbons that enter the internal volume through the inlet 120 and flow towards the outlet 122. The increase in flow resistance results in an increase in residence time of the hydrocarbons, allowing the hydrocarbons to carry a larger quantity of tracers out of the apparatus 102. In some implementations, an entirety of the internal volume can be filled with the beads. In some implementations, a portion of the internal volume can be isolated, e.g., with plates, and the beads can be filled only within the isolated portion. In this manner, the residence time can be modified by modifying the size of the porous bed of beads. The residence time can also be modified by modifying the size of the beads. Larger beads will result in lesser pressure drop across the length of the porous bed, thereby reducing the residence time. Conversely, smaller beads will result in larger pressure drop, thereby increasing the residence time. The techniques of filling the apparatus 102 (FIG. 1A) with the porous bed of beads can also be applied to the apparatus 200 (FIG. 2). Further, beads are one example of porous media. Other porous media (e.g., gels, sponges, etc.) can be used in place of or in combination with beads.

Figure 4:
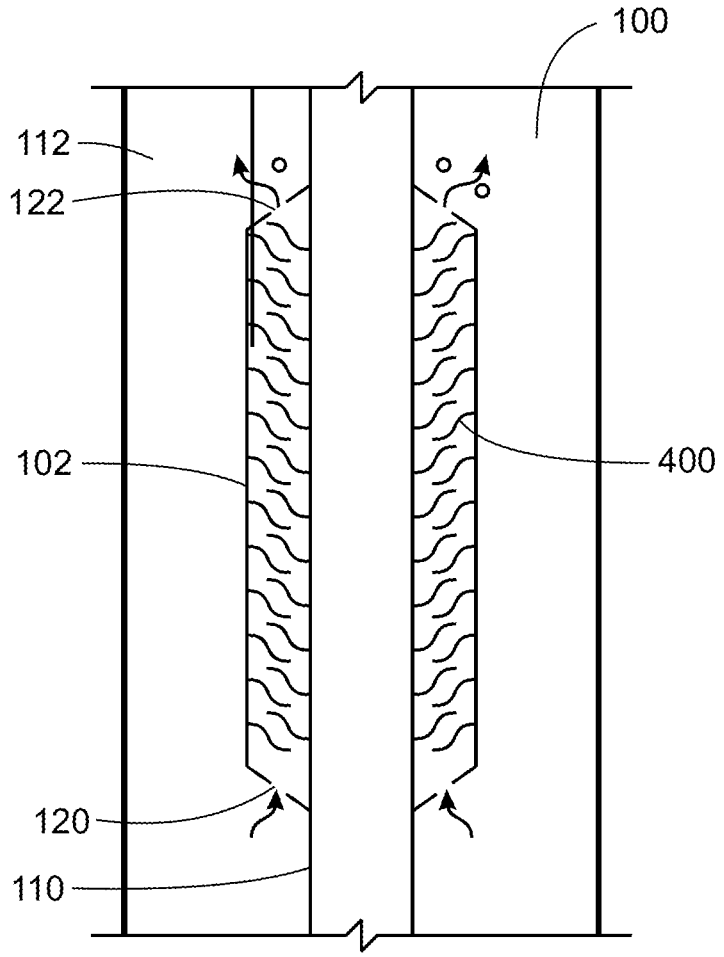
FIG. 4 is an example of a schematic view of a tracer injection apparatus filled with multiple baffles.

FIG. 4 is an example of a schematic view of a tracer injection apparatus 102 filled with multiple baffles. A baffle 400 is a physical structure made of metal or other material (e.g., plastic or polymer or any material that does not degrade in downhole conditions). The physical structure can be formed as a plate or a project that has two ends—a first end which is attached to an inner wall within the internal volume of the apparatus 102, and the second end that extends away from the first end. In some implementations, each baffle extends in a direction that is perpendicular to (or at a non-zero angle to) the direction of flow of fluids from the inlet to the outlet of the apparatus 102. When multiple such baffles are disposed within the internal volume, a tortuous path is created from the inlet to the outlet of the apparatus 102. Because the hydrocarbons have to flow through the tortuous path, a residence time of the hydrocarbons within the internal volume increases. The tracers can be flowed into the internal volume after the baffles have been formed/installed. The dosing line can extend into the internal volume to fill/refill the internal volume with the tracers. The techniques of forming the tortuous path in the apparatus 102 (FIG. 1A) can also be applied to the apparatus 200 (FIG. 2).

Figure 5:
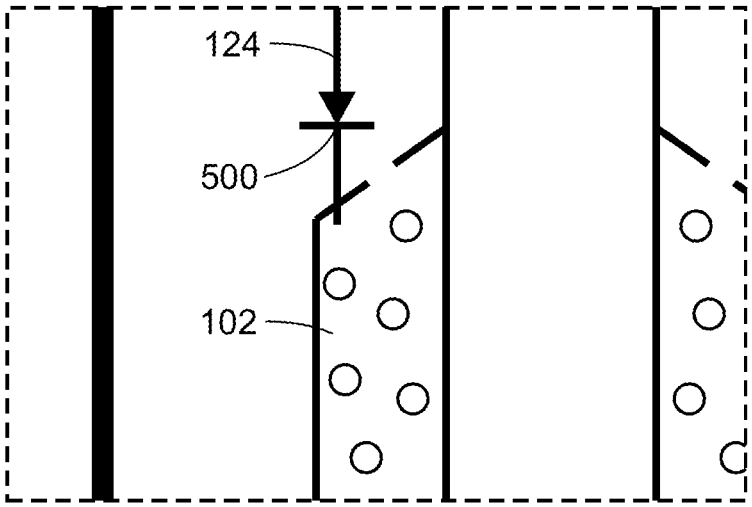
FIG. 5 is an example of a dosing line into a tracer injection apparatus.

FIG. 5 is an example of a dosing line 124 into a tracer injection apparatus 102. The techniques described with reference to FIG. 5 are also applicable to the tracer injection apparatus 200. In some implementations, a one-way check valve 500 can be fluidically disposed in the dosing line 124 outside the apparatus 102. The check valve 500 permits fluid flow into the apparatus 102, but prevents the fluid flow out of the apparatus 102. By doing so, the check valve 500 permits fluids with tracers to be flowed into the apparatus 102, and prevents bleed out of tracer through the dosing line. By reducing tracer bleed out using the check valve after the injection is stopped, a clearer decay curve can be obtained during the transient operation.

Figure 6:
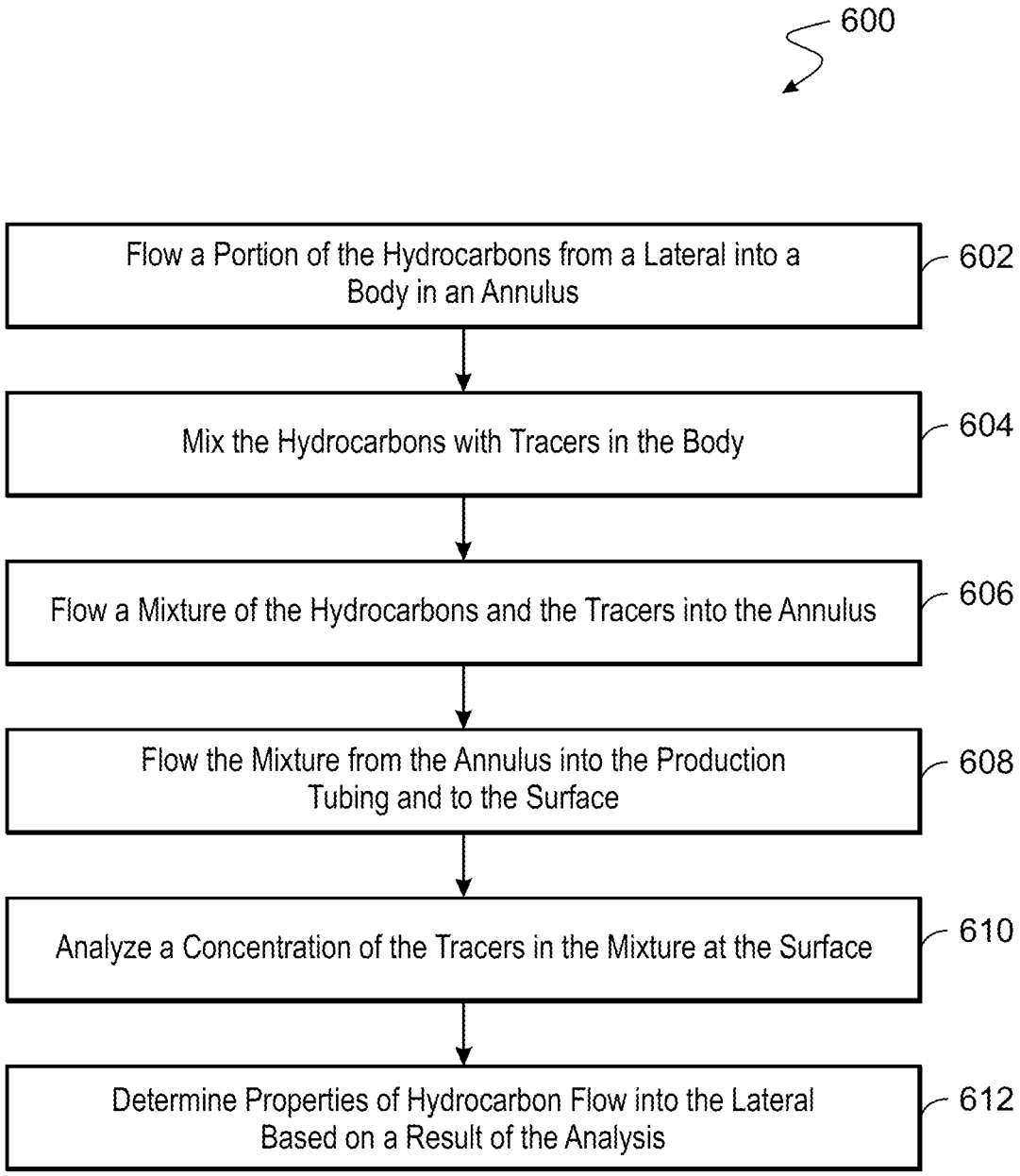
FIG. 6 is a flowchart of an example of a process of using a tracer injection apparatus.

FIG. 6 is a flowchart of an example of a process 600 of using a tracer injection apparatus (e.g., the apparatus 102 of FIG. 1A or the apparatus 200 of FIG. 2). For example, the wellbore 100 is formed in the subterranean zone 104 from a surface of the Earth. The lateral 108 is formed from the wellbore into the subterranean zone 104. Hydrocarbons entrapped in the subterranean zone flow into the lateral. The wellbore production tubing 110 is installed within the wellbore and extends towards the lateral. The tubing 110 defines the annulus 112 between the outer surface of the tubing 110 and the inner wall of the wellbore 100. The body of the apparatus 102, which is attached to the tubing 110 (e.g., either as shown and described with reference to FIG. 1A or FIG. 2) defines an internal volume. At 602, a portion of the hydrocarbons flows from the lateral 108 into the internal volume of the apparatus 102.

At 604, the hydrocarbons flowed into the body of the apparatus 102 mix with tracers in the body. For example, the apparatus 102 is filled with tracers that are flowed into the internal volume from the surface through the dosing line 124. The hydrocarbons that enter the internal volume while flowing in an uphole direction towards the surface mix with the tracers that already reside within the internal volume.

At 606, a mixture of the hydrocarbons and the tracers is flowed into the annulus. For example, whereas the hydrocarbons entered the internal volume through the inlet 120, a mixture of the hydrocarbons and the tracer exits the internal volume through the outlet 122 downstream of the inlet 120. The mixture that exits the internal volume flows into the annulus 112.

At 608, the mixture is flowed from the annulus into the production tubing and to the surface. For example, the ICV 114 is opened to permit the mixture of the hydrocarbons and the tracers to enter the tubing 110 and to flow to the surface.

At 610, a concentration of the tracers in the mixture is analyzed at the surface. For example, after a portion of the mixture of the tracers and hydrocarbons has flowed to the surface, tracer injection is shut-off. Samples of the mixture are obtained at the surface at different times and analyzed to determine a decay rate of the tracers.

At 612, properties of hydrocarbon flow in the lateral are determined based on a result of the analysis that was performed at the surface. For example, using the type of tracers collected at the surface, a percentage of the total flow coming from the zone into the lateral 108 is determined.

In some implementations, the process 600 can be extended to a multi-lateral well in which each lateral is formed in a respective zone. Flow from each lateral into the motherbore is isolated using multiple packers. Different apparatuses are attached to the production tubing in each isolated zone upstream of respective laterals. Each apparatus can be filled with respective tracers that are distinguishable from each other. In some implementations, each apparatus can include mechanisms (e.g., porous beads or baffles to form a tortuous pathway) to increase residence times of hydrocarbons in the respective apparatuses. By collecting samples from the different zones at the surface and analyzing tracers in the samples, the contributions of the different zones to the hydrocarbon flow through the motherbore can be determined. In addition, by implementing the transient analysis techniques, decay rates of tracers from each zone can be determined to further determine properties of the hydrocarbon flow from the different zones.

Thus, particular implementations of the subject matter have been described. Other implementations are within the scope of the following claims.

The invention claimed is:

1. A method comprising:

in a wellbore formed in a subterranean zone from a surface of the Earth, a lateral formed from the wellbore into the subterranean zone, hydrocarbons entrapped in the subterranean zone flowing into the lateral, a wellbore production tubing installed within the wellbore and extending toward the lateral, the wellbore production tubing defining an annulus between an outer surface of the wellbore production tubing and an inner wall of the wellbore:

flowing, within an internal volume defined by an elongated, ring-shaped body wrapped around the outer surface of the wellbore production tubing and through an inlet formed on a surface of the body, a portion of the hydrocarbons flowing from the lateral into the annulus, wherein the internal volume resides in the annulus defined by the wellbore production tubing;

mixing, within the internal volume, the portion of the hydrocarbons with tracers residing within the internal volume;

flowing, out of an outlet formed on the surface of the body and towards the surface, a mixture of the portion of the hydrocarbons with a portion of the tracers, wherein the mixture flows towards the surface in the annulus defined by the wellbore production tubing;

flowing the mixture from the annulus into the wellbore production tubing and towards the surface;

analyzing, at the surface, a concentration of the tracers in the mixture flowed to the surface; and determining, based on a result of the analyzing, properties of hydrocarbon flow into the lateral.

2. The method of claim 1, wherein flowing the portion of the hydrocarbons within the internal volume defined by the body comprises attaching the body to the outer surface of the wellbore production tubing at a downhole location that is downstream of an inlet to the lateral.

3. The method of claim 2, wherein the inlet formed on the surface of the body is downstream of the inlet to the lateral and the outlet formed on the surface of the body is downstream of the inlet formed on the surface of the body, wherein flowing the portion of the hydrocarbons within the internal volume comprises flowing the portion of the hydrocarbons into the inlet formed on the surface of the body.

4. The method of claim 3, further comprising flowing the tracers into the internal volume before flowing the portion of the hydrocarbons into the inlet formed on the surface of the body.

5. The method of claim 4, further comprising flowing the tracers from a reservoir at the surface through a flowline that extends from the surface to within the internal volume of the body.

6. The method of claim 5, further comprising fluidically disposing a check valve in the flowline, the check valve configured to permit flow of the tracers within the internal volume through the flowline and to prevent flow out of the internal volume through the flowline.

7. The method of claim 4, wherein analyzing the concentration of the tracers in the mixture flowed to the surface comprises, after flowing the mixture into the wellbore production tubing:

shutting flow of the tracers into the internal volume; and measuring a time rate of decay of the concentration of the tracers reaching the surface of the wellbore.

8. The method of claim 2, wherein flowing the mixture into the wellbore production tubing and towards the surface comprises operating an inflow control valve to flow the mixture from the annulus into the wellbore production tubing.

9. The method of claim 1, wherein flowing, out of the internal volume and towards the surface, the mixture of the portion of the hydrocarbons with a portion of the tracers comprises increasing a duration for which the portion of the hydrocarbons resides within the internal volume before flowing the mixture out of the internal volume.

10. The method of claim 9, wherein increasing the duration comprises filling the internal volume with porous beads between the inlet formed on the surface of the body and the outlet formed on the surface of the body.

11. The method of claim 10, wherein increasing the duration comprises positioning a plurality of baffles within the internal volume between the inlet formed on the surface of the body and the outlet formed on the surface of the body.

12. An apparatus comprising:

a body defining an internal volume, the body configured to be attached to an outer surface of a wellbore production tubing in an annulus defined by the outer surface of the wellbore production tubing and an inner wall of a wellbore formed in a subterranean zone from a surface of the Earth, a lateral formed in the subterranean zone, wherein hydrocarbons entrapped in the subterranean zone flow into the lateral, into the annulus and towards the surface;

an inlet to and outlet from the internal volume, each defined on a surface of the body, wherein, when the body is attached to the outer surface of the wellbore production tubing with the inlet nearer to the lateral than the outlet, the inlet allows at least a portion of the hydrocarbons to enter the internal volume and the outlet allows at least the portion of the hydrocarbons to exit the internal volume, wherein the outlet is configured to flow the portion of the hydrocarbons into the annulus defined by the outer surface of the wellbore production tubing;

a dosing line extending from the surface to within the internal volume, the dosing line configured to flow fluid from the surface to the body; and a tracer configured to be flowed into the internal volume from the surface through the dosing line, at least a portion of the tracer configured to mingle with at least the portion of the hydrocarbons that enter the internal volume through the inlet and to flow out of the body and to the surface with at least the portion of the hydrocarbons that exit through the outlet, wherein a concentration of at least the portion of the tracer at the surface is indicative of a percentage of a total hydrocarbon flow coming into the lateral from the subterranean zone.

13. The apparatus of claim 12, wherein the body comprises a plurality of beads positioned within the internal volume, the plurality of beads forming a porous bed of beads between the inlet and the outlet, wherein the tracer is distributed across the porous bed of beads.

14. The apparatus of claim 12, wherein the body comprises a plurality of baffles formed within the internal volume, a first end of each baffle attached to an inner surface of the body, a second end of each baffle extending away from the inner surface into the internal volume, the plurality of baffles defining a tortuous flow path between the inlet and the outlet.

15. The apparatus of claim 12, wherein the body defines a ring shape with a hollow center, wherein the ring-shaped body is configured to be wrapped around the wellbore production tubing.

16. The apparatus of claim 12, further comprising a strap configured to attach the body to the outer surface of the wellbore production tubing.

17. The apparatus of claim 12, further comprising a check valve fluidically coupled to the dosing line, the check valve configured to permit fluid flow from the surface into the body and to prevent fluid flow out of the body.

18. A method comprising:

in a wellbore formed in a subterranean zone from a surface of the Earth, a lateral formed from the wellbore into the subterranean zone, hydrocarbons entrapped in the subterranean zone flowing into the lateral, a wellbore production tubing installed within the wellbore and extending toward the lateral, the wellbore production tubing defining an annulus between an outer surface of the wellbore production tubing and an inner wall of the wellbore:

flowing, within an internal volume defined by a body attached to the outer surface of the wellbore production tubing, a portion of the hydrocarbons flowing from the lateral into the annulus;

mixing, within the internal volume, the portion of the hydrocarbons with tracers residing within the internal volume;

flowing, out of the internal volume and towards the surface, a mixture of the portion of the hydrocarbons with a portion of the tracers;

flowing the mixture into the wellbore production tubing and towards the surface;

analyzing, at the surface, a concentration of the tracers in the mixture flowed to the surface by:

shutting flow of the tracers into the internal volume after flowing the mixture into the wellbore production tubing, and measuring a time rate of decay of the concentration of the tracers reaching the surface of the wellbore; and determining, based on a result of the analyzing, properties of hydrocarbon flow into the lateral.

* * * * *